US008012040B2

(12) United States Patent
Takechi

(10) Patent No.: US 8,012,040 B2
(45) Date of Patent: Sep. 6, 2011

(54) IRON GOLF CLUB HEAD

(75) Inventor: Takaharu Takechi, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 161 days.

(21) Appl. No.: 12/370,143

(22) Filed: Feb. 12, 2009

(65) Prior Publication Data

US 2009/0325729 A1 Dec. 31, 2009

(30) Foreign Application Priority Data

Jun. 30, 2008 (JP) ..... 2008-170727

(51) Int. Cl.
*A63B 53/04* (2006.01)

(52) U.S. Cl. ..... 473/329; 473/342; 473/346; 473/349; 473/350

(58) Field of Classification Search ..... 473/324–350, 473/287–292

See application file for complete search history.

(56) References Cited

U.S. PATENT DOCUMENTS

| | | | | |
|---|---|---|---|---|
| 5,090,702 | A | 2/1992 | Viste | |
| 5,184,823 | A | 2/1993 | Desboilles et al. | |
| 5,509,660 | A * | 4/1996 | Elmer | 473/288 |
| 5,776,010 | A | 7/1998 | Helmstetter et al. | |
| 5,833,551 | A | 11/1998 | Vincent et al. | |
| 5,842,934 | A | 12/1998 | Ezaki et al. | |
| 5,971,868 | A | 10/1999 | Kosmatka | |
| 6,171,203 | B1 * | 1/2001 | Huang | 473/305 |
| 6,299,549 | B1 * | 10/2001 | Shieh | 473/342 |
| 6,616,546 | B2 | 9/2003 | Cho | |
| 6,746,342 | B1 * | 6/2004 | Hsieh | 473/342 |
| 6,780,123 | B2 | 8/2004 | Hasebe | |
| 6,984,180 | B2 | 1/2006 | Hasebe | |
| 7,115,048 | B2 | 10/2006 | Kusumoto et al. | |
| 7,121,958 | B2 * | 10/2006 | Cheng et al. | 473/345 |
| 7,125,343 | B2 | 10/2006 | Imamoto | |
| 7,186,191 | B2 * | 3/2007 | Chen et al. | 473/345 |
| 7,207,899 | B2 | 4/2007 | Imamoto | |
| 7,232,377 | B2 | 6/2007 | Gilbert et al. | |
| 7,232,381 | B2 | 6/2007 | Imamoto et al. | |
| 7,258,628 | B2 * | 8/2007 | Huang et al. | 473/342 |
| 7,303,486 | B2 | 12/2007 | Imamoto | |
| 7,371,188 | B2 * | 5/2008 | Chen | 473/329 |
| 7,410,427 | B2 | 8/2008 | Imamoto et al. | |
| 7,621,824 | B2 * | 11/2009 | Sano | 473/345 |
| 2005/0245325 | A1 | 11/2005 | Gilbert et al. | |
| 2006/0111198 | A1 | 5/2006 | Matsunaga | |
| 2006/0252576 | A1 * | 11/2006 | Lo | 473/342 |
| 2006/0293119 | A1 * | 12/2006 | Hou | 473/342 |

(Continued)

FOREIGN PATENT DOCUMENTS

JP 6-39061 A 2/1994

(Continued)

*Primary Examiner* — Sebastiano Passaniti
(74) *Attorney, Agent, or Firm* — Paul Hastings LLP

(57) ABSTRACT

A golf club head (1) comprises a head main body (10) having a concave portion (11) formed in the face side and a face plate (20) fixed to the head main body (10). The face plate (20) is mounted on the head main body (10) such that a concave step portion (21) engages with a convex step portion (16*a*) of the head main body (10), and the upper edge portion, lower edge portion, and toe-side edge portion of the face plate (20) abut against edge portions (13), (14), and (15) of the head main body, respectively. The face plate (20) is laser-welded along its perimeter and fixed to the head main body (10).

11 Claims, 5 Drawing Sheets

U.S. PATENT DOCUMENTS

| | | | |
|---|---|---|---|
| 2007/0066420 | A1 | 3/2007 | Imamoto et al. |
| 2007/0129165 | A1 | 6/2007 | Matsunaga et al. |
| 2007/0129166 | A1 | 6/2007 | Shimazaki et al. |
| 2007/0129168 | A1 | 6/2007 | Matsunaga et al. |
| 2008/0085782 | A1 | 4/2008 | Kubota |

FOREIGN PATENT DOCUMENTS

| | | | |
|---|---|---|---|
| JP | 9-192273 | A | 7/1997 |
| JP | 11-347160 | A | 12/1999 |
| JP | 11-347161 | A | 12/1999 |
| JP | 2002-143356 | A | 5/2002 |
| JP | 2002-186696 | A | 7/2002 |
| JP | 2002-253710 | A | 9/2002 |
| JP | 2003-33450 | A | 2/2003 |
| JP | 2003-33453 | A | 2/2003 |
| JP | 2003-47678 | A | 2/2003 |
| JP | 2003-62132 | A | 3/2003 |
| JP | 2003-265652 | A | 9/2003 |
| JP | 2003-265653 | A | 9/2003 |
| JP | 2004-105521 | A | 4/2004 |
| JP | 2004-141451 | A | 5/2004 |
| JP | 2005-21649 | A | 1/2005 |
| JP | 2005-28170 | A | 2/2005 |
| JP | 2005-160948 | A | 6/2005 |
| JP | 2005-278757 | A | 10/2005 |
| JP | 2005-319122 | A | 11/2005 |
| JP | 2006-149449 | A | 6/2006 |
| JP | 2007-21210 | A | 2/2007 |
| JP | 2007-135888 | A | 6/2007 |
| JP | 2007-229071 | A | 9/2007 |
| JP | 2004-89434 | A | 5/2009 |

* cited by examiner

IRON GOLF CLUB HEAD

BACKGROUND OF THE INVENTION

1. Field of the Invention

The present invention relates to an iron golf club head, and particularly to a hollow iron golf club head.

2. Description of the Related Art

As is well known, an iron golf club head includes a face portion having a flat face and a hosel portion which continues to the face portion on the heel side. A shaft insertion hole is provided in the hosel portion. A shaft is inserted into this shaft insertion hole and fixed thereto with an adhesive.

As a hollow iron golf club head, an iron head is described in Japanese Patent Laid-Open No. 2004-105521, which includes a head main body having a concave portion formed in the face side and a face plate fixed to the head main body, and in which the rear surfaces of the upper edge portion, lower edge portion and toe-side edge portion of the face plate are fixed to the front surface of the peripheral portion of the head main body.

In the iron head described in the above-described Japanese Patent Laid-Open No. 2004-105521, the heel-side edge portion of the face plate does not overlap the head main body. In this conventional example, the end face of the face plate on the heel side and the end face facing the concave portion of the head main body are both in a target line direction. These end faces are abutted against each other and laser-welded. In this manner, the rear surface side of the heel-side edge portion of the face plate is not received by the head main body in this conventional example. With this arrangement, the face plate on the heel side easily flexes upon hitting a ball thereon.

However, it is difficult to align the face plate with the head main body only by abutting the end face of the face plate on the heel side against the end face of the head main body on the heel side. In addition, the connection strength of the face plate on the heel side and the head main body may become insufficient.

SUMMARY OF THE INVENTION

The present invention has as its object to provide an iron golf club head in which alignment of a face plate is facilitated and the connection strength of the face plate on the heel side and a head main body is improved.

According to the present invention, there is provided an iron golf club head comprising a head main body having a concave portion formed in a face side, and a face plate fixed to the head main body, rear surfaces of an upper edge portion, a lower edge portion, and a toe-side edge portion of the face plate being fixed to a front surface of a periphery portion of the head main body, wherein a concave step portion is provided on a rear surface side of a heel-side edge portion of the face plate, and the concave step portion engages with and fixed to a convex step portion provided in a heel-side end edge facing the convex portion of the head main body.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 1:
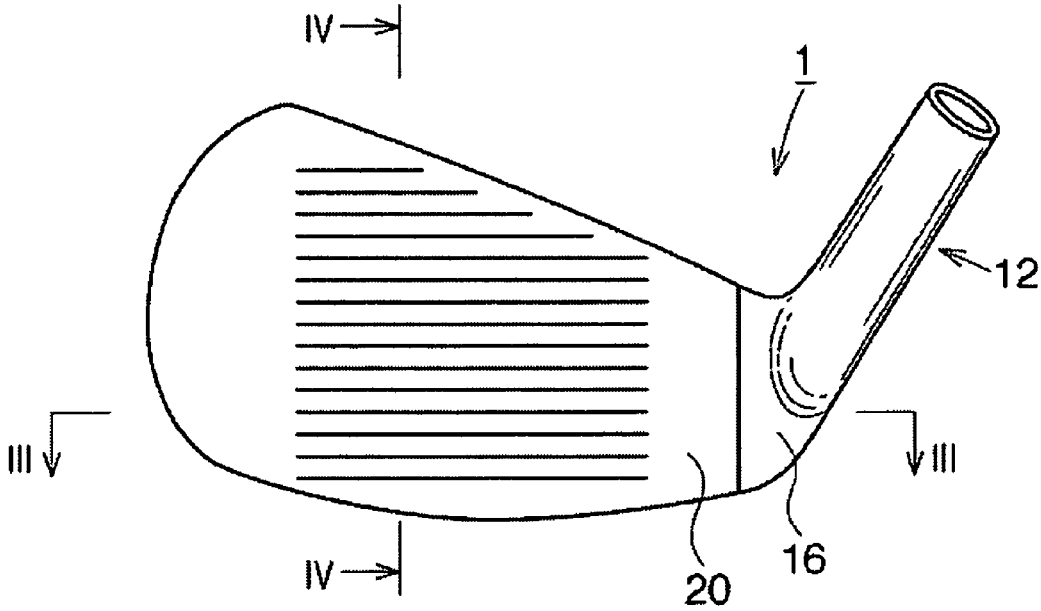
FIG. 1 is a front view of an iron golf club head 1 according to an embodiment of the present invention.
Figure 2:
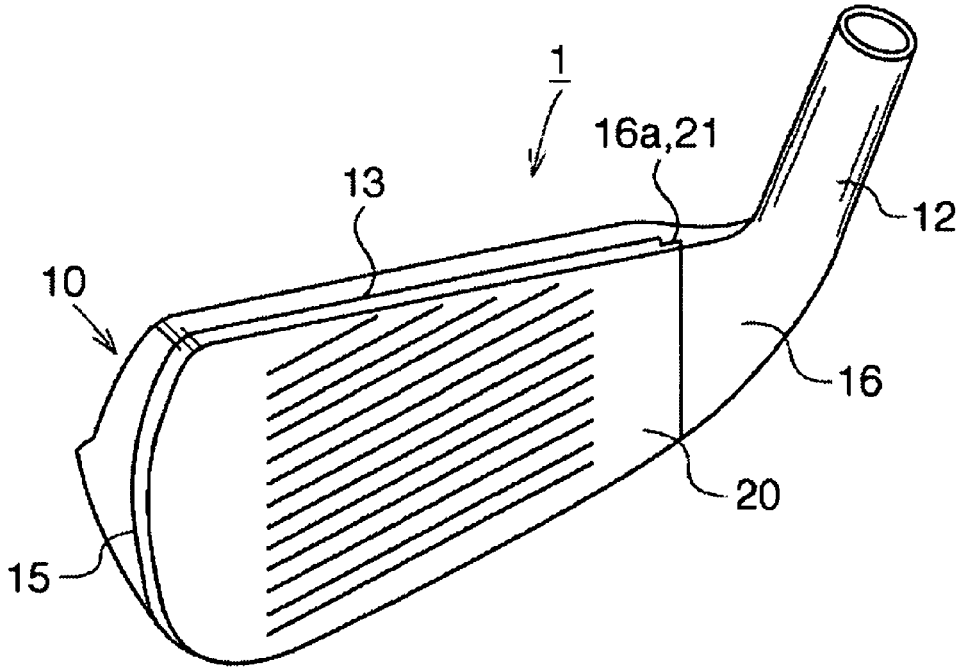
FIG. 2 is a perspective view of the iron golf club head 1.
Figure 3:
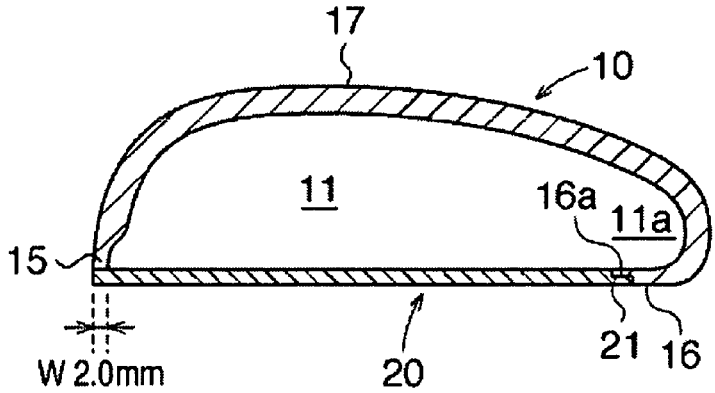
FIG. 3 is a sectional view taken along a line III-III in FIG. 1.
Figure 4:
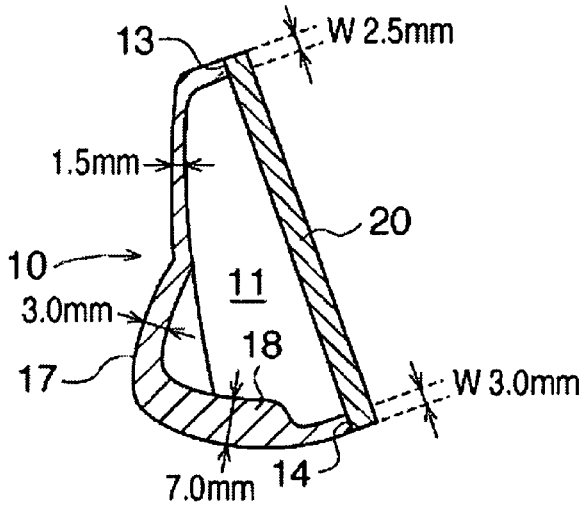
FIG. 4 is a sectional view taken along a line IV-IV in FIG. 1.
Figure 5:
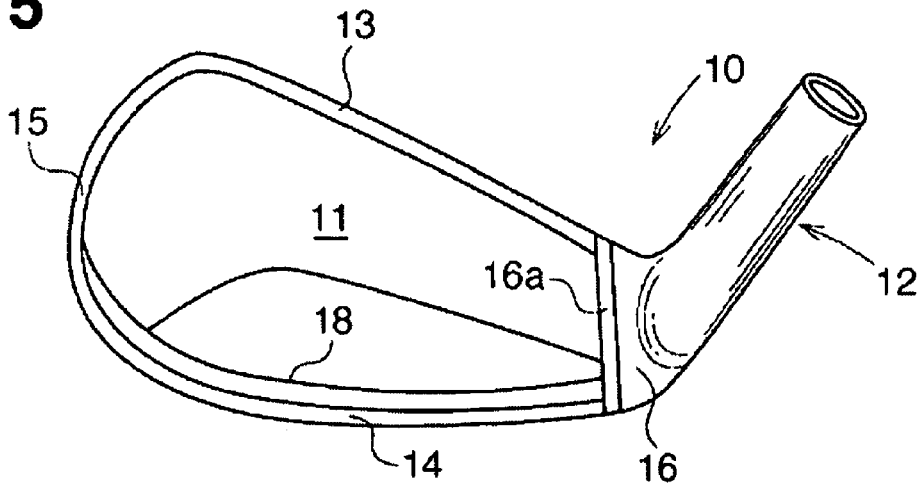
FIG. 5 is a front view of a head main body 10.
Figure 6A:
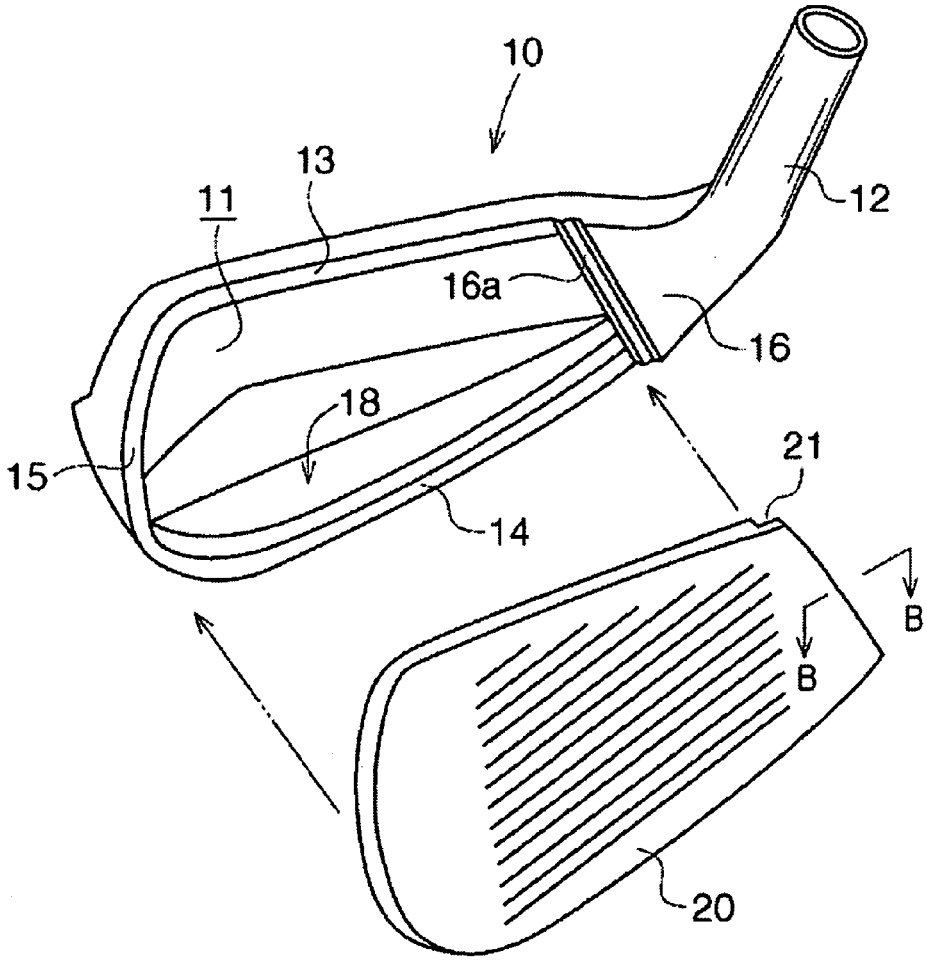
FIG. 6A is an exploded perspective view of the head main body 10.
Figure 6B:
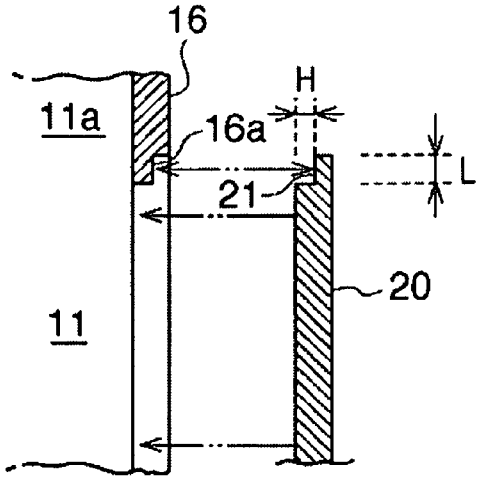
FIG. 6B is a sectional view of a part of the head main body 10.

FIG. 1 is a front view of an iron golf club head 1 according to an embodiment of the present invention. FIG. 2 is a perspective view of the iron golf club head 1. FIG. 3 is a sectional view taken along a line III-III in FIG. 1. FIG. 4 is a sectional view taken along a line IV-IV in FIG. 1. FIG. 5 is a front view of a head main body 10. FIG. 6A is an exploded perspective view of the golf club head 1, and FIG. 6B is a sectional view taken along a line B-B in FIG. 6A.

The iron golf club head 1 includes the head main body 10 having a concave portion 11 formed in the face side, and a face plate 20 fixed to the head main body 10. The face plate 20 includes a flat front surface (striking face) on which score lines (grooves) are formed.

A hosel portion 12 is provided in the head main body 10 on the heel side.

As shown in FIG. 6A, an upper edge portion (top side) 13, a lower edge portion (sole side) 14, and a toe-side edge portion 15 of the face portion of the head main body 10 are recessed by the thickness of the face plate 20 with respect to a heel-side front surface portion 16 of the head main body 10. Widths W of the edge portions 13, 14, and 15 are preferably 1 mm to 4 mm, and particularly about 2 mm to 3 mm. In the embodiment, Widths W of the edge portions 13, 14, and 15 satisfy the following formula:

$$\text{Width } W \text{ of the edge portion 14} > \text{Width } W \text{ of the edge portion 13} > \text{Width } W \text{ of the edge portion 15}$$

On the back side of the heel-side front surface portion 16 of the head main body 10, a hollow portion 11*a* which continues to the concave portion 11 is formed.

A convex step portion 16*a* is provided in the end edge of the face portion 16 facing the concave portion 11. This convex step portion 16*a* continuously extends from the upper end to the lower end of the face portion.

On the rear surface side of the head main body 10, its lower half side extends backward so as to form a bulge portion 17 (FIG. 4). The bulge portion 17 is larger in thickness than the upper half side of the rear surface side, thereby achieving a low and deep center of gravity. When a center of gravity is deep, a position of a center of gravity on the face becomes high in association with a loft angle. For this reason, the lower half side of the rear surface side is formed to be larger in thickness than the upper half side so as not to make the center of gravity high. Particularly, such a design with a low center of gravity is preferable for a long iron with a loft angle of 24° or less. When the lower side is extended and the width of a sole portion is increased, a low center of gravity can be achieved. The sole surface of the head main body 10 includes a thick-walled portion 18 which is thicker on the back portion side than on the front portion side. The lower edge portion 14 of the head main body is formed to be thicker than the upper edge portion 13 so as to achieve the low center of gravity of the head.

The face plate 20 has a size to cover the concave portion 11. A concave step portion 21 is formed on the rear surface of the heel-side edge portion of the face plate 20. This concave step portion 21 is formed in a corner portion where the heel-side end edge and rear surface of the face plate 20 intersect. This concave step portion 21 continuously extends from the heel-side upper end to the heel-side lower end of the face plate 20. The concave step portion 21 and the convex step portion 16*a* have the same dimensions.

A height H of the concave step portion 21 shown in FIG. 6B is preferably 0.6 mm to 1.2 mm, and particularly about 0.8 mm to 1.0 mm. An extension length L of the concave step portion 21 is preferably 0.5 mm to 1.4 mm, and particularly about 0.8 mm to 1.0 mm.

The face plate 20 is mounted on the head main body 10 such that its concave step portion 21 engages with the convex step portion 16*a* of the head main body 10, and the upper edge portion, lower edge portion, and toe-side edge portion of the face plate 20 abut against the edge portions 13, 14, and 15 of the head main body, respectively. The face plate 20 is laser-welded along its perimeter and fixed to the head main body 10. In this iron golf club head 1, the connection portion of the front surface of the face plate 20 is flush with the front surface portion 16.

In the iron golf club head 1 having the above-described arrangement, since the concave step portion 21 of the heel-side edge portion of the face plate 20 engages with and welded to the convex step portion 16*a* of the head main body 10, alignment of the face plate 20 is easy and the connection strength of the face plate 20 on the heel side and the head main body 10 is high.

Note that since the concave step portion 21 and convex step portion 16*a* extend from the upper end to the lower end of the face portion, the connection strength of the face plate 20 on the heel side and the head main body 10 becomes high.

In addition, since the widths W of the front surfaces of the upper edge portion, lower edge portion, and toe-side edge portion of the head main body 10 are 1 mm to 4 mm, and particularly 2 mm to 3 mm, the connection strength of the face plate 20 and the head main body 10 in each of these portions is high.

In this embodiment, since the head main body 10 has the hollow portion 11*a* on the back side of the front surface portion 16, it is possible to reduce the weight of the head main body 10 by the weight corresponding to the hollow portion 11*a* and increase the weight on the sole side or back side by the reduced weight corresponding to the hollow portion. With this arrangement, it is possible to enlarge the sweet area, achieve a low center of gravity, or increase the center of gravity depth, without increasing the weight of the golf club head. In addition, the face becomes too easily flexed and, particularly in case of a long iron, the initial ball speed increases.

Another Embodiment

In the present invention, the face plate can have a uniform thickness except the concave step portion 21, but the thickness in the vicinity of the sweet area may be increased.

Figure 7A:
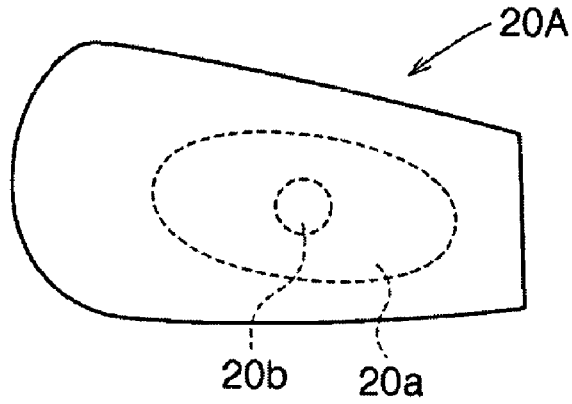
FIGS. 7A to 7C are views for explaining a face plate 20A used in another embodiment of the present invention.
Figure 7B:
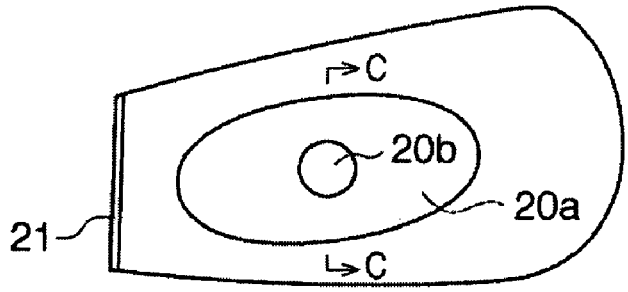
Figure 7C:
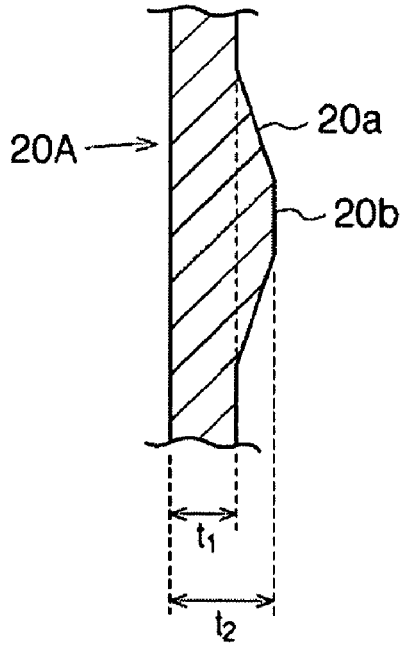

FIG. 7A is a front view of a face plate 20A, FIG. 7B is a rear view of the same, and FIG. 7C is a sectional view taken along a line C-C in FIG. 7B. The face plate 20A includes a thickness increasing zone 20*a* where the thickness gradually increases toward the central portion in the sweet area, and a maximum thickness zone 20*b* with a uniform thickness around the center of the sweet area. A thickness $t_1$ of the general portion of the face plate 20A is preferably 1.8 mm to 2.4 mm, and particularly about 1.8 mm to 2.0 mm. A thickness $t_2$ of the maximum thickness zone 20*b* is desirably 2.2 mm to 2.8 mm, and particularly about 2.3 mm to 2.5 mm.

Figure 8A:
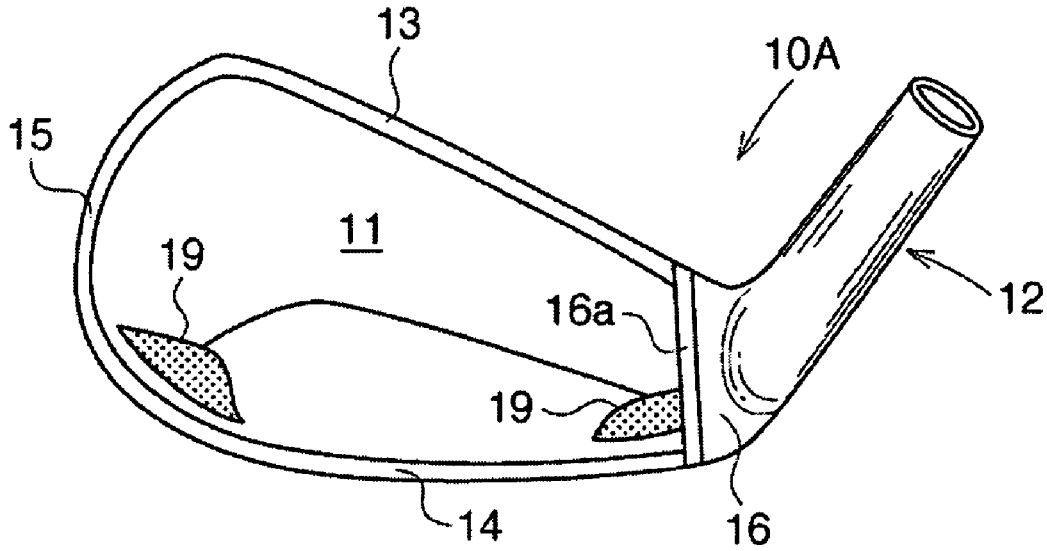
FIGS. 8A and 8B are views for explaining a head main body 10A used in another embodiment of the present invention.
Figure 8B:
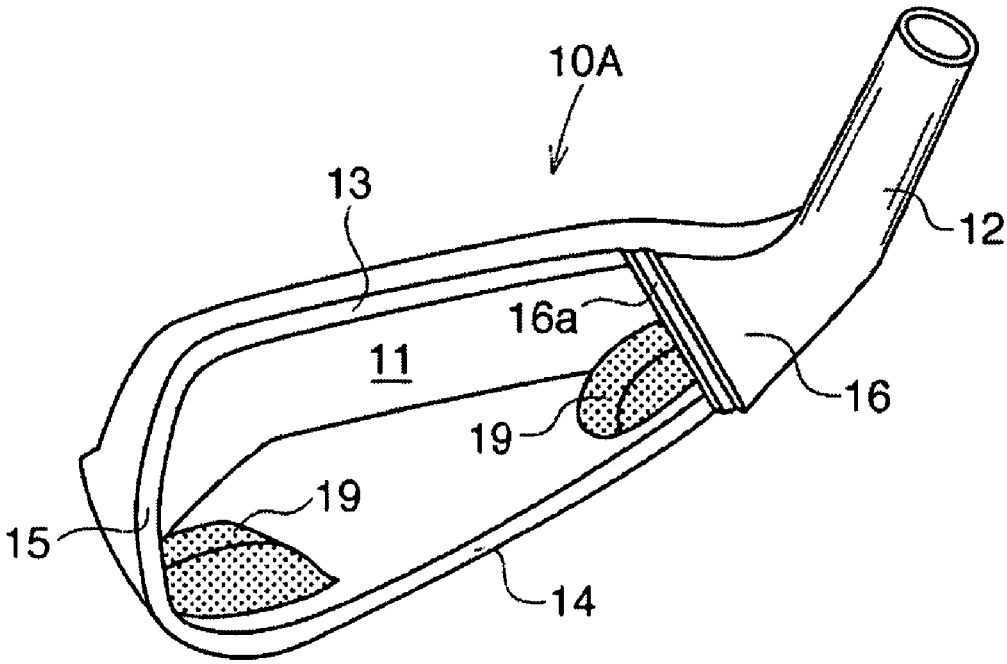

In the present invention, like a head main body 10A in FIGS. 8A and 8B, weight portions 19 made of a high specific gravity metal such as a tungsten alloy may be provided on the toe side and heel side so that the sweet area is enlarged in the toe-and-heel direction.

FIG. 8A is a front view of the head main body 10A, and FIG. 8B is a perspective view of the same. Other components of the head main body 10A are the same as those of the head main body 10, and the same reference numerals denote the same components.

A head main body 10 for a No. 3 iron (a loft angle of 21°) was formed using SUS630 shown in Table 1. Widths W of edge portions 13, 14, and 15 and the thicknesses of the respective portions were those shown in FIGS. 3 and 4. The end edge of a front surface portion 16 was cut to form a convex step portion 16*a*.

TABLE 1

| Head Main Body | |
|---|---|
| Composition | Material SUS630 wt % |
| C | 0.07 |
| Mn | 1.00 |
| Si | 1.00 |
| Cr | 15.5 to 17.5 |
| Ni | 3.0 to 5.0 |
| P | 0.04 |
| S | 0.03 |
| Cu | 3.0 to 5.0 |
| Nb + Ta | 0.15 to 0.45 |
| Fe | Balance |

A face plate was cut from a rolled plate material made of SUS415. Score lines (grooves) were formed by an engraving machine. A concave step portion 21 was formed by cutting. The concave step portion 21 and convex step portion 16*a* had the same dimensions. The concave step portion 21 had dimensions of H=1 mm and L=1 mm.

The face plate having the arrangement shown in FIGS. 7A to 7C was used, in which $t_1$=2 mm and $(t_2-t_1)$=0.5 mm. When a material with a high strength was used for the face, it was possible to design a thin face. Therefore, the face plate made of CUSTOM455 (registered trademark) having a composition shown in Table 2 was used. The properties of these materials are shown in Table 3.

TABLE 2

| Face Plate | |
|---|---|
| Composition | Material Custom455 wt % |
| C | 0.05 |
| Mn | 0.05 |
| Si | 0.05 |
| Cr | 11.0 to 12.5 |
| Ni | 7.5 to 9.5 |
| P | 0.04 |
| S | 0.03 |
| Mo | 0.5 |

TABLE 2-continued

| Face Plate | |
|---|---|
| Composition | Material Custom455 wt % |
| Cu | 3.0 to 5.0 |
| Ti | 0.8 to 1.4 |
| Nb | 0.1 to 0.5 |
| Fe | Balance |

TABLE 3

| Properties of Materials | | | |
|---|---|---|---|
| | | Material | |
| | Unit | SUS630 | Custom455 |
| Density | g/cm | 7.7 to 8.03 | 7.7 to 8.03 |
| Poisson Ratio | | 0.27 to 0.30 | 0.27 to 0.30 |
| Elastic Modulus | Gpa | 196 | 190 to 210 |
| Tensile Strength | Mpa | 1070 | 1620 |
| Extension | % | 12 | 8 |
| Hardness | HRC | 35 to 42 | 47 |

When the face plate and head main body were laser-welded, an iron golf club head which had a high connection strength of the face plate and head main body and an excellent repulsion performance was obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-170727, filed Jun. 30, 2008, which is hereby incorporated by reference herein in its entirety.

What is claimed is:

1. An iron golf club head comprising a head main body having a concave portion formed in a face side, and a face plate having a flat rear surface and fixed to said head main body, the flat rear surface in an upper edge portion, a lower edge portion, and a toe-side edge portion of said face plate being fixed to a front surface of a periphery portion of said head main body, wherein:

a concave step portion is provided on a rear surface side of a heel-side edge portion of said face plate;

said concave step portion engages with and is fixed to a convex step portion provided in a heel-side end edge facing said concave portion of said head main body; and said concave step portion and said convex step portion extend from an upper end to lower end of a face portion.

2. The head according to claim 1, wherein widths W of an upper edge portion, a lower edge portion, and a toe-side edge portion of said head main body are 1 mm to 4 mm.

3. The head according to claim 1, wherein a hollow portion communicating with said concave portion is provided on the heel side closer than said concave portion of said head main body.

4. The head according to claim 1, wherein a width of a lower edge portion of said head main body>a width of an upper edge portion of said main body>a width of a toe-side edge portion of said main body.

5. The head according to claim 1, wherein the head main body further comprises a hollow bulge portion extending from a lower half of a rear surface of the head main body in a direction opposite the face plate.

6. The head according to claim 5, wherein a wall thickness of the hollow bulge portion is greater than a wall thickness of an upper half of the rear surface of the head main body.

7. The head according to claim 1, wherein said head main body includes a sole portion of the head, and a wall thickness of a rear side portion of the sole portion is greater than a wall thickness of a face side portion of the sole portion.

8. The head according to claim 7, wherein the wall thickness of the rear side portion of the sole portion is greater than widths of a lower edge portion, an upper edge portion and a toe-side edge portion of said main body.

9. The head according to claim 1, wherein the head main body is made of a first metal material, and the face plate is made of a second metal material whose tensile strength is higher than a tensile strength of the first metal material.

10. An iron golf club head comprising a head main body having a concave portion formed in a face side, and a face plate fixed to said head main body, wherein a rear surface of said face plate comprises a central portion and a flat portion surrounding the center portion, said flat portion is fixed to a front surface of a periphery portion of said head main body, a concave step portion is provided on a rear surface side of a heel-side edge portion of said face plate, said concave step portion engages with and is fixed to a convex step portion provided in a heel-side end edge facing said concave portion of said head main body, and said concave step portion and said convex step portion extend from an upper end to a lower end of a face portion.

11. The head according to claim 10, wherein the face plate has a first thickness in the flat portion and a second thickness thicker than the first thickness in the central portion.

* * * * *